US009472179B1

(12) United States Patent
Cai

(10) Patent No.: US 9,472,179 B1
(45) Date of Patent: Oct. 18, 2016

(54) SOUND ABSORBER

(71) Applicant: Xiaobing Cai, London (CA)

(72) Inventor: Xiaobing Cai, London (CA)

( * ) Notice: Subject to any disclaimer, the term of this patent is extended or adjusted under 35 U.S.C. 154(b) by 0 days.

(21) Appl. No.: 14/846,741

(22) Filed: Sep. 5, 2015

(51) Int. Cl.
*G10K 11/16* (2006.01)

(52) U.S. Cl.
CPC ..... *G10K 11/16* (2013.01); *G10K 2210/32272* (2013.01)

(58) Field of Classification Search
CPC ..... G10K 11/16; E04B 1/86
USPC ..... 181/229, 210, 286, 284, 292
See application file for complete search history.

(56) References Cited

U.S. PATENT DOCUMENTS 2,541,159 A * 2/1951 Geiger ..... E04B 1/84 181/208
3,819,009 A * 6/1974 Motsinger ..... F02C 7/045 181/292
4,106,587 A * 8/1978 Nash ..... G10K 11/172 181/213
5,241,512 A * 8/1993 Argy ..... G10K 11/172 181/198
6,698,390 B1 * 3/2004 Kostun ..... F02M 35/1222 123/184.57
7,337,875 B2 * 3/2008 Proscia ..... F02C 7/045 181/210
7,395,898 B2 * 7/2008 Yang ..... G10K 11/172 181/286
8,616,330 B1 * 12/2013 McKnight ..... G10K 11/16 181/207
8,857,564 B2 * 10/2014 Ma ..... G10K 11/18 181/284
2005/0284690 A1 * 12/2005 Proscia ..... F02C 7/045 181/214
2006/0027204 A1 * 2/2006 Vogt ..... F02M 35/1283 123/184.57

* cited by examiner

*Primary Examiner* — Forrest M Phillips

(57) ABSTRACT

A sound absorbing structure comprising a set of nesting components having increasing size, each of said components being enclosed by the next larger said component, each of said components and its next larger component defining an aperture and a cavity, and said apertures and said cavities forming a set of Helmholtz resonators having increasing size, dissipating sound energy over a wide frequency range.

17 Claims, 5 Drawing Sheets

SOUND ABSORBER

TECHNICAL FIELD

This invention relates to a sound absorbing structure having a set of nesting Helmholtz resonators of graduated size, and dissipates sound waves with a series of different frequencies.

BACKGROUND OF THE INVENTION

Noise mitigation remains a big and common issue in our society, although many progresses have been achieved in past decades. Several types of industrial sound absorbing materials or structures are available for noise cancelling, ranging from open-cell foams, fibrous materials, and perforated panels. However, the challenges of cancelling noise still exist in a variety of environments, especially when dimension and self-weight of the sound absorbers are sensitive concerns. For example, the noise inside an airplane is a main source that affects flight comfort, but to maximize fuel economy, it is impracticable to remove the noise by using above mentioned regular sound absorbers, because they require excessively large space to generate significant dissipation for low frequency noises.

The prospect of delivering a satisfied sound absorption by conventional sound absorbers with a limited thickness is still not optimistic. It is widely recognized that the thickness of ¼ wavelength is a precondition to achieve full sound absorption by conventional sound absorbers. Generally, sound absorbers are porous materials and structures, and usually installed on or attached to a rigid surface with or without a designated distance. When the airborne sound waves impinge onto the absorbers, pressurized airflow is driven to penetrate into the pores of the absorbers and moves through the walls within the absorbers. Therefore, viscous frictions are generated and acoustic energy is converted into heat. However, this process happens efficiently only when the path of airflow inside the absorbers is sufficiently long, i.e. the absorbers are sufficiently thick. To cancel a common sound of 500 Hz, the required absorbers may be as thick as 170 mm, which greatly restricts their application.

Although there may exist one possible approach to overcome the limitation of ¼ wavelength, which is adopting resonance, such as Helmholtz resonance, the narrow bandwidth nature of the Helmholtz resonance greatly sets back its popularization. Various sound absorbers containing Helmholtz resonators have been designed for purpose of noise absorption, e.g., Helmholtz absorber containing extended necks, Helmholtz absorber comprising tuneable sized cavities, or even combination of Helmholtz absorber and porous materials. Due to the strict condition for generating Helmholtz resonance, almost all Helmholtz resonator based absorbers are effective in a narrow frequency band. People may combine a group of Helmholtz resonators with different sizes to broaden the frequency band, however, most designs of this kind would have significantly reduced the amplitude of sound absorption, because a reduction of porosity may happen to each individual Helmholtz resonator when a combination of several Helmholtz resonators is used.

In addition, conventional sound absorbers generally do not present aesthetically pleasing exteriors due to their porous nature. The sound absorbers may be installed behind acoustic transparent facings capable of preserving acceptable colourful images. However, the acoustic facings, typically fabrics, still cause attenuations to lights and thus are less likely to be widely favoured for decoration. Other facings such as perforated panels also have limitations as they are not fully acoustic transparent and may pose restrictions on the bandwidth of the sound absorbers.

BRIEF SUMMARY OF THE INVENTION

Therefore, the object of the present invention is to propose a thin sound absorber which has a significantly reduced thickness, as compared with normally required ¼ wavelength, and has good sound absorbing functions, including both high absorption coefficient and simultaneously, broad bandwidth.

The object of the present invention is reached by a sound absorber having the characteristics of claim 1 or claim 7.

The advantages of the sound absorber according to the present invention originate from its compact nesting layout of its functional elements, i.e. Helmholtz resonators, defined by a set of thin components having increasing size and each of said component received in and spaced from the next larger one, so that an extremely space saving arrangement for assembling a series of Helmholtz resonators have been achieved.

According to the present invention, the sound absorber has a broad bandwidth characteristic, since its functional Helmholtz resonators have graduated size and therefore resonate at a series of different frequencies that cover a wide frequency range.

In addition, the sound absorber according to the present invention has a lightweight nature, because the Helmholtz resonators are principally apertures and cavities and are established by thin wall components.

Fundamentally distinct from conventional sound absorbers comprising Helmholtz resonators which have apertures (also named as ports or necks) locate at the top center of the cavities, the Helmholtz resonators of the sound absorber according to the present invention have apertures (or ports, necks) around the peripheries of the cavities. This essential improvement enables the compactness and space saving characteristic of the sound absorber according to the present invention.

The sound absorber according to the present invention is also advantageous in its aesthetical appearance. The unique layout allows the apertures of the sound absorber according to the present invention to have a wide choice of shapes and configurations, enabling the sound absorber to have diverse exteriors and to present pleasing appearances.

DETAILED DESCRIPTION OF THE INVENTION

Figure 1:
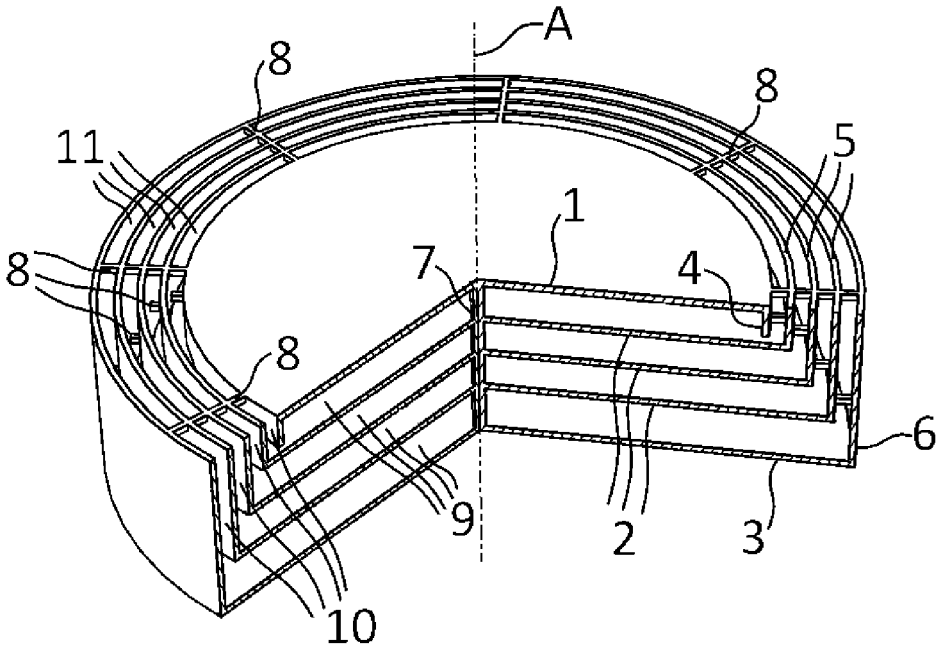
FIG. 1 is a cutaway view of a circular sound absorber in accordance with a principal embodiment according to the present invention.

A principle embodiment of a sound absorber according to the present invention is described by referring to FIG. 1. As can be seen in FIG. 1, the sound absorber comprises a set of 5 components having graduated size. Inversely along the longitudinal axis A, from top to bottom, these components are the inner most component 1, middle components 2, and outer most component 3 respectively. In this embodiment, each of the components has a configuration of a circular bucket, and each is received in a next larger component till the outer most component 3. The components are separated and form cavities 9 and apertures 10 therebetween, defined by the bottoms and side walls of two adjacent components.

The layout and spatial position of the components are realized and maintained by a group of supporting structures, i.e., the central support 7 and side supports 8. The component 1 and component 3 are basic parts, while the number of middle components 2 may vary. The typical number of middle components 2 is between 2 and 8, a smaller number and a larger number of middle components 2 are also normal, depending on the target sound frequency range.

As can further be seen from FIG. 1, the apertures 10 each is defined by the side walls of a component and the next larger component that receives it, the cavities 9 each is defined by the bottoms and side walls of two neighbouring components. The cavities 9 between the bottoms of the components are implemented with the existence of the central support 7, while the apertures 10 between the side walls (4, 5, 6) of the components are implemented with the existences of the side supports 8. Therefore, the apertures 10 have circular annular configurations and the cavities 9 have short cylinder configurations. The apertures 10 stay on top of said cylindrical cavities 9 and connect to the cavities 9 along the peripheries of said cavities 9. A series of Helmholtz resonators are therefore established, with each Helmholtz resonator composes of a cavity and an associated annular aperture.

As can additionally be seen from FIG. 1, the formed Helmholtz resonators have increasing size and have configurations of chunk circular buckets. From top to bottom, each Helmholtz resonator is enclosed by a next larger Helmholtz resonator. Therefore, these Helmholtz resonators resonate at a series of decreasing frequencies that cover a frequency range with a certain bandwidth. The working frequency range can be further tuned by adjusting the sizes of the cavities 9 and apertures 10. Accordingly, the sound absorber composing of these Helmholtz resonators can be well tuned to absorb sound waves over a designated broad bandwidth.

As can also be seen from FIG. 1, the inner most component 1 is placed in an orientation opposite to the rest components, and the Helmholtz resonator formed thereof has a cavity enclosed by its annular aperture. The openings 11 of all the apertures 10, together with the bottom of the inner most component 1, lie in the same level and in one plane that perpendicular to the longitudinal axis A. The overall height or thickness of the sound absorber is therefore determined by the height of the outer most component 3, i.e. the largest component. The bottom of the outer most component 3 is preferred to be flat, though a non-flat bottom is also allowable to fit the installation condition.

As can further be seen from FIG. 1, except the inner most component 1 and outer most component 3, each middle component serves as a wall separating two neighbouring Helmholtz resonators. The total number of said Helmholtz resonators equals to the total number of said components minus one.

As can additionally be seen from FIG. 1, said a set of components are arranged concentrically and have non-variable circumferences from bottom to top along the longitudinal axis A, which enables the non-variable radius width of each said annular aperture that equals to the distance between the side walls of one said component and the next larger said component that receives the previous one. Similarly, the bottoms of said components are all arranged parallel, and are all perpendicular to the longitudinal axis A, which eliminates location dependent height (or depth) variations within each of said cylindrical cavities.

As can additionally be seen from FIG. 1, the support structures (7, 8) are vital to maintain the layout of the components (1, 2, 3), and to provide specific sizes for the Helmholtz resonators defined therebetween. The formations and shapes of the support structures (7, 8), however, are free to choose, as long as they do not significantly affect the characteristics of the Helmholtz resonators. They may exist as parts of said components (1, 2, 3), or may exist as independent structures placed inside said apertures 10 and said cavities 9 of said Helmholtz resonances. Also it is normal that due to the existence of side support structures 8, the annular apertures are divided into several separated sub-apertures, so a Helmholtz resonator may contain a plurality of sub-apertures connected to one cavity. It is also allowable that the cavity is simultaneously divided into a plurality of sub-cavities by the central support 7.

Figure 2:
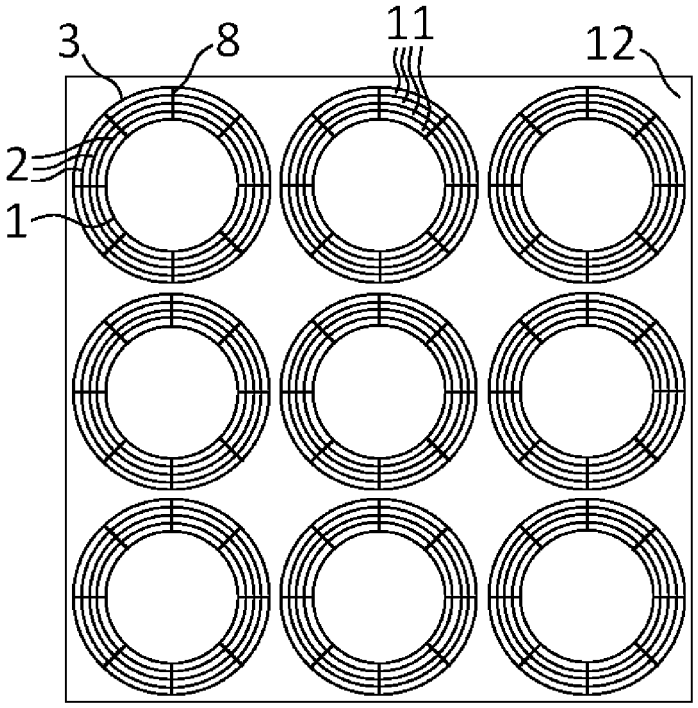
FIG. 2 is a top view of an array of square-arranged sound absorbers according to FIG. 1.
Figure 3:
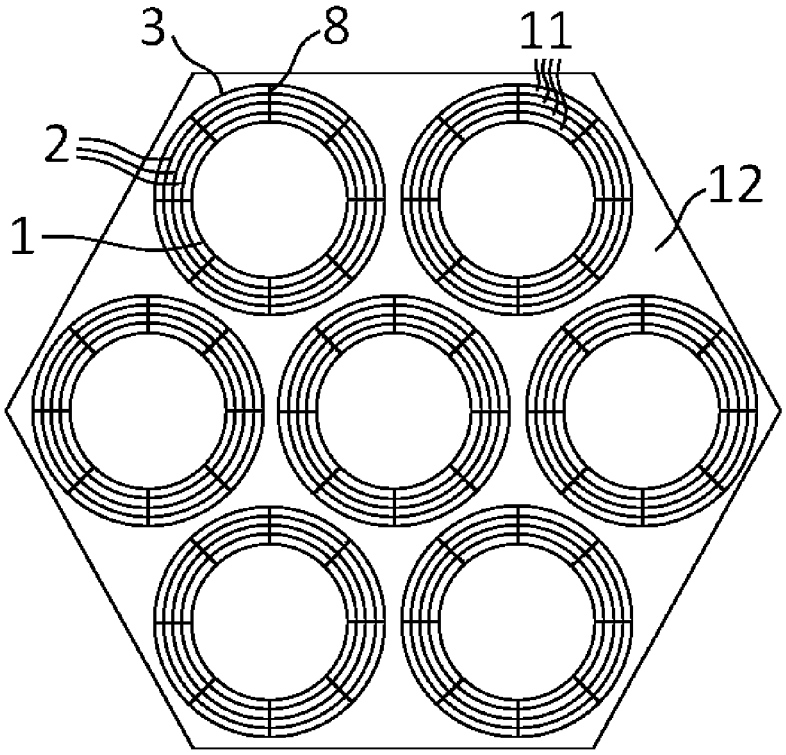
FIG. 3 is a top view of an array of hexagonally arranged sound absorbers according to FIG. 1.

It is advantageous that an array of sound absorbers described in FIG. 1 are square arranged and installed on a panel 12, with the openings 11 of the apertures facing the incident sound waves, as can be best seen in FIG. 2. Principally, each of the sound absorbers works independently, although slight coupling effect from the neighbouring sound absorbers may exist. It is also preferable that the sound absorbers are hexagonally arranged, as described in FIG. 3. The hexagonal arrangement provides the sound absorbers a high ratio in a limited space, thus enables a better sound absorption characteristic.

Figure 4:
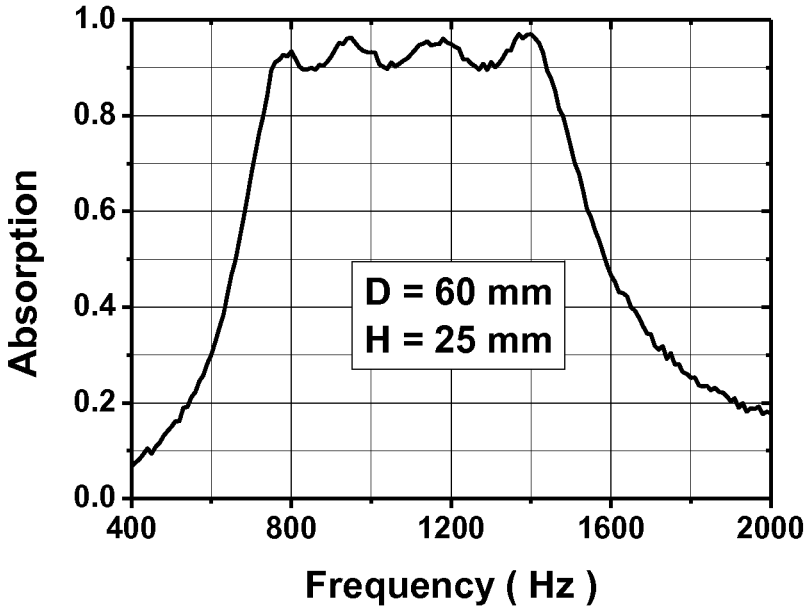
FIG. 4 is a graph illustrating sound absorption coefficient of a sound absorber according to FIG. 1.

As can be seen in FIG. 4, sound absorption coefficient is illustrated for a sound absorber described in FIG. 1, which has an overall diameter of 60 mm and a thickness of 25 mm, and which comprises a set of 5 said components, and accordingly, composes of 4 Helmholtz resonators. A high sound absorption coefficient 0.9 over a broad bandwidth, i.e., 750 Hz-1450 Hz, is demonstrated. For conventional sound absorbing materials or structures, the required thickness calculated from ¼ wavelength for the same frequency range would be 125 mm. The improvement and advantage of the sound absorber according to the present invention is remarkable. A further lowering down of the operational frequency range is imaginable if a larger overall diameter is adopted.

Figure 5:
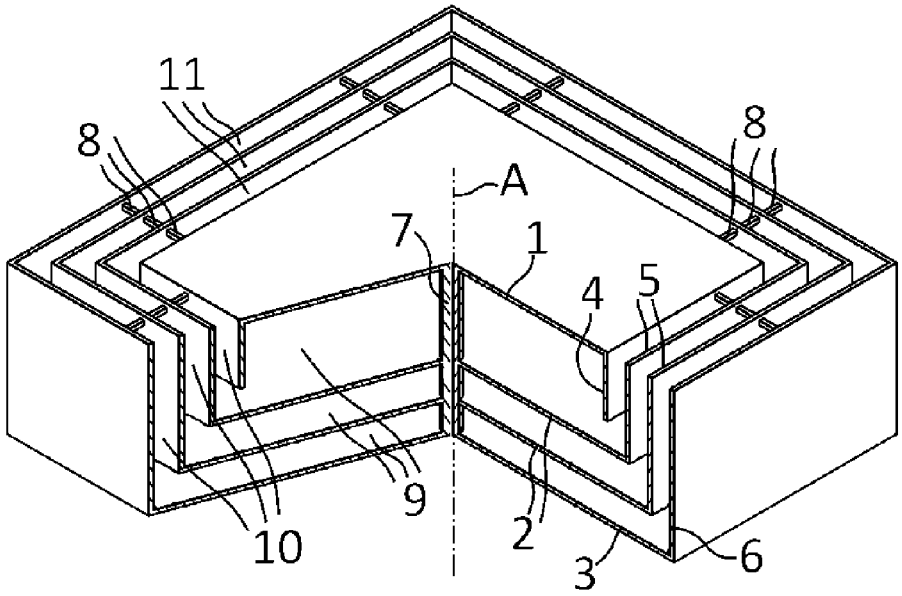
FIG. 5 is a cutaway view of a square sound absorber in accordance with another preferred embodiment according to the present invention.
Figure 6:
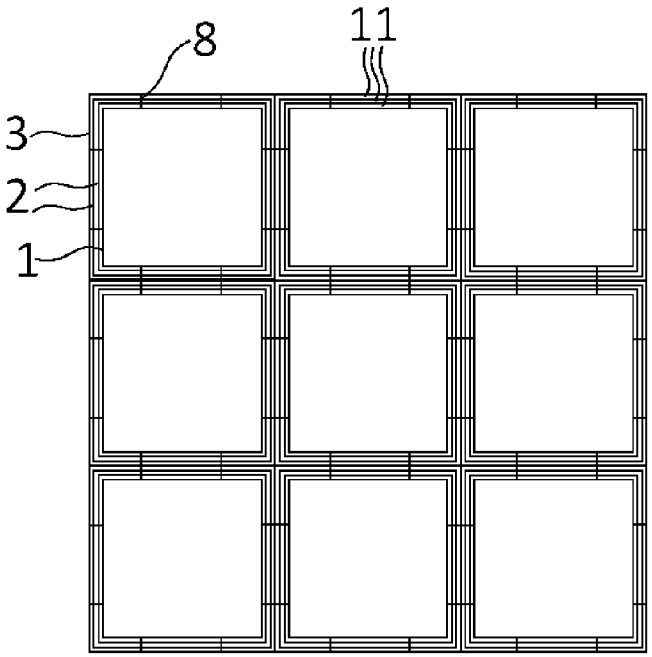
FIG. 6 is a top view of an array of square-arranged sound absorbers according to FIG. 5.

FIG. 5 is another preferred embodiment of the sound absorber according to the present invention, for which the said components (1, 2, 3) have square configurations. The said components (1, 2, 3) thus each resembles a square tank, comprising four equal sized side walls (4, 5, 6) and one bottom. Therefore, said Helmholtz resonators defined by the said components (1, 2, 3) have square cuboid cavities (9) and narrow square annular apertures (10). FIG. 6 illustrates an advantageous layout of the square sound absorbers described in FIG. 5, that an array of the square sound absorbers are closely placed one by one, leaving no spare spaces, thus provides a possibly highest ratio and an optimal sound absorption.

As can additionally be seen from FIG. 5 and FIG. 6, each square absorber comprises 4 square components (1, 2, 3), and contains 3 Helmholtz resonators, each further contains one cavity and one aperture.

Figure 7:
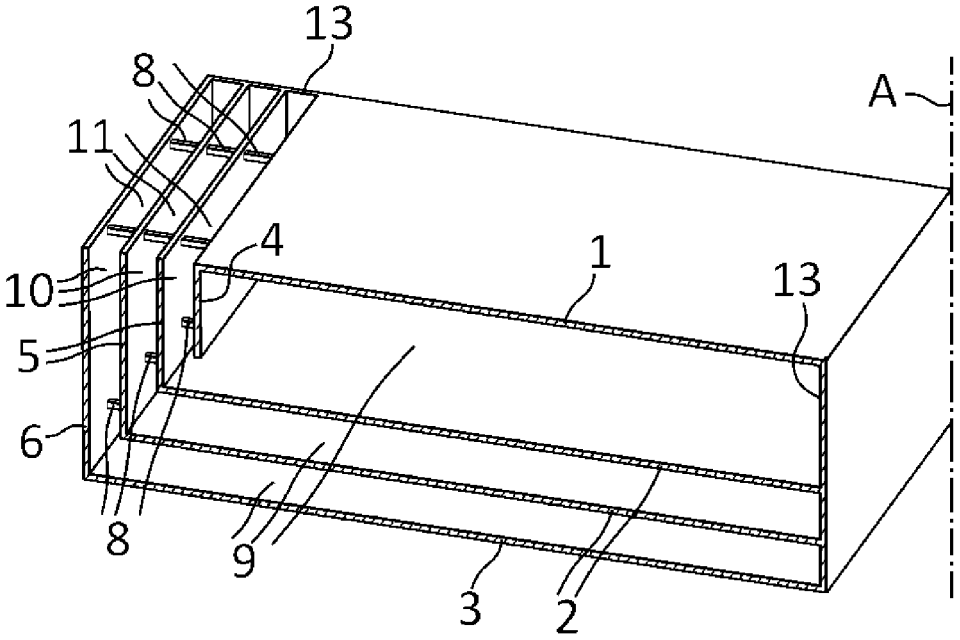
FIG. 7 is a cutaway and side sectional view of a rectangular sound absorber in accordance with another embodiment according to the present invention.
Figure 8:
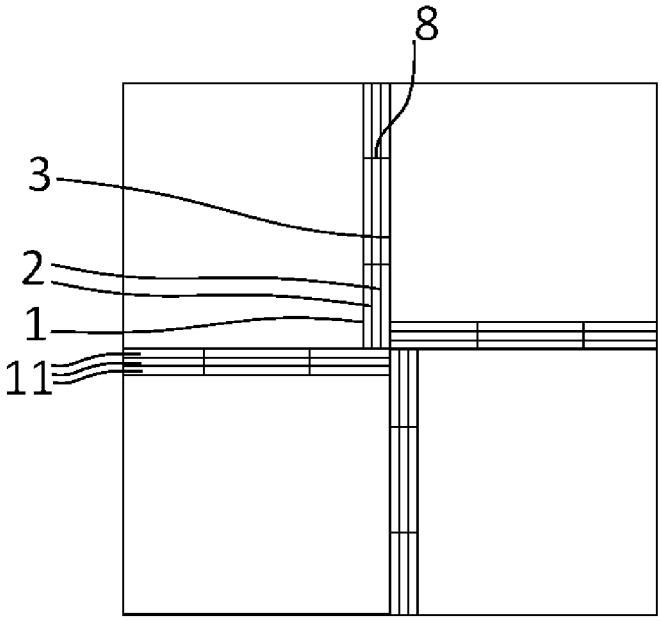
FIG. 8 is a top view of an array of square-arranged sound absorbers according to FIG. 7.
Figure 9:
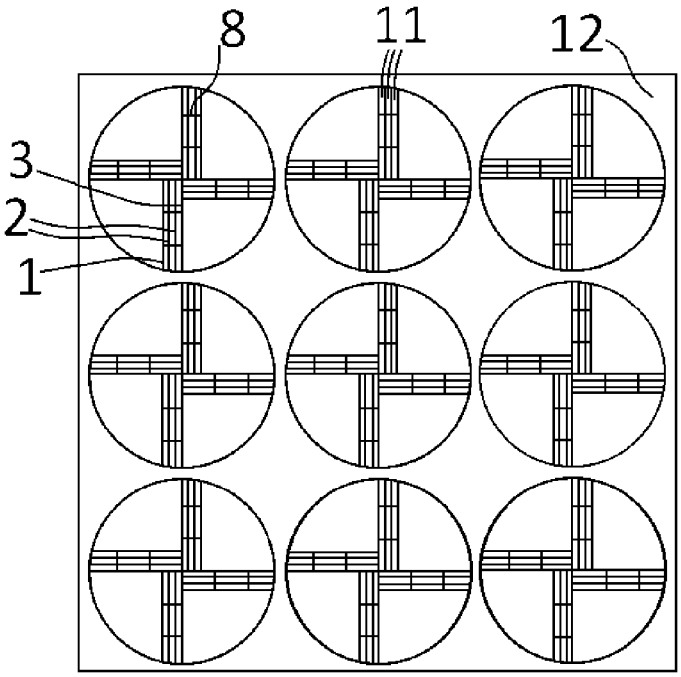
FIG. 9 is a top view of an array of square arranged circular sector sound absorbers in accordance with another embodiment according to the present invention.

FIG. 7 describes another embodiment of the sound absorber according to the present invention, in which said components (1, 2, 3) have rectangular configurations and share three side walls (13) (one of the side walls is not shown in FIG. 7 as this is a sectional view). In this embodiment, the apertures 10 only stretch along one side of the components, where the side walls are not shared. So the formed Helmholtz resonators are non-symmetric, neither axial symmetric as that in FIG. 1, nor rotational symmetric as that in FIG. 5. FIG. 8 provides an advantageous arrangement of the rectangular sound absorbers described in FIG. 7, that four said sound absorbers are rotationally placed as a group, leaving no spare space. FIG. 9 shows another array of square arranged circular sector sound absorbers in accordance with a further embodiment that contains shared side walls according to the present invention.

Figure 10:
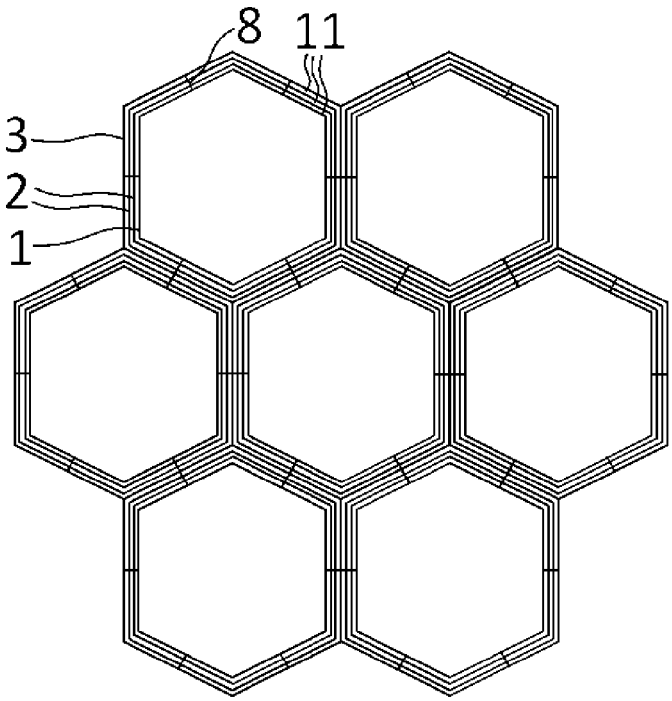
FIG. 10 is a top view of an array of hexagonally arranged hexagonal sound absorbers in accordance with another preferred embodiment according to the present invention.

As can additionally be seen in FIG. 10, another preferred embodiment of an array of hexagonally arranged sound absorber having hexagonal configurations is described. The said components thus each resembles a hexagonal tank, comprising six equal sized side walls and one bottom. Therefore, said Helmholtz resonators defined by the said components have hexagonal cavities and narrow hexagonal annular apertures. The hexagonal arrangement and configuration not only provides a more aesthetic appearance, but also ensures the maximum space efficiency.

The invention claimed is:

1. A sound absorber comprising a plurality of members and a plurality of supporting structures supporting said plurality of members, said plurality of members having increasing size, each said member configured to be received in and spaced from its next larger member, so as to define therebetween an upper annular aperture and a paired lower cavity, wherein said annular aperture is penetrable by said sound and in communication with the periphery of said paired cavity.

2. The sound absorber according to claim 1, wherein each said member has a bottom and at least one peripheral wall extending from said bottom to a top opening spaced from said bottom.

3. The sound absorber according to claim 2, wherein said peripheral wall and said bottom of each said member substantially have uniform thickness.

4. The sound absorber according to claim 2, wherein each said annular aperture is defined by said peripheral walls of one said member and its next larger member receiving it.

5. The sound absorber according to claim 2, wherein each said cavity is defined by said bottoms and said peripheral walls of one said member and its next larger member receiving it.

6. The sound absorber according to claim 1, wherein the space defined by each of said plurality of aired cavities and apertures is enclosed by the annular space defined by the aperture of its next larger paired cavity and aperture.

7. The sound absorber according to claim 1, wherein each said aperture substantially has a longitudinally and circumferentially non-variable radial width.

8. The sound absorber according to claim 1, wherein the sound penetrable openings of all said apertures lie in the same level and in one plane that perpendicular to the longitudinal direction.

9. The sound absorber according to claim 2, wherein the smallest member is arranged in an orientation opposite to the rest members.

10. The sound absorber according to claim 1, wherein each of the said cavities substantially has a radially and circumferentially non-variable longitudinal height.

11. The sound absorber according to claim 1, wherein each said cavity is substantially in communication with one said paired aperture.

12. The sound absorber according to claim 1, wherein the top view configurations of said members are selected from a group consisting: circular, sector, triangle, square, rectangle, diamond, hexagon, pentagon, octagon, star, and heart.

13. The sound absorber according to claim 1, wherein said supporting structures are substantially acoustically resistant free.

14. The sound absorber according to claim 1, wherein said supporting structures are integrated with said members.

15. The sound absorber according to claim 1, wherein said aperture and said cavity are divided by the supporting structures, into a plurality of sub-apertures and a plurality of sub-cavities.

16. A sound absorber comprising: a plurality of members having increasing size, each of said plurality of members configured to be received in and at least partially spaced from its next larger member, so as to define therebetween a lower cavity and a paired upper elongated aperture, wherein said elongated aperture is penetrable by said sound and in communication with at least a part of the periphery of said paired cavity, a plurality of supporting structures supporting said plurality of members.

17. The sound absorber according to claim 16, wherein the space defined by each of said plurality of paired cavities and apertures is skirted by the elongated space defined by the aperture of its next lager paired cavity and aperture.

* * * * *